US007247075B2

(12) United States Patent
von Oech

(10) Patent No.: US 7,247,075 B2
(45) Date of Patent: Jul. 24, 2007

(54) GOLDEN RHOMBIC PYRAMID-SHAPED BUILDING BLOCKS

(76) Inventor: Roger V. von Oech, 99 Edwards La., Atherton, CA (US) 94027

( * ) Notice: Subject to any disclaimer, the term of this patent is extended or adjusted under 35 U.S.C. 154(b) by 58 days.

(21) Appl. No.: 10/988,910

(22) Filed: Nov. 15, 2004

(65) Prior Publication Data

US 2006/0105666 A1 May 18, 2006

(51) Int. Cl.
*A63H 33/04* (2006.01)

(52) U.S. Cl. ..... 446/92; 446/124; 52/81.1; 273/153 S

(58) Field of Classification Search ..... 446/85, 446/102, 124, 129, 92; 273/157 R
See application file for complete search history.

(56) References Cited

U.S. PATENT DOCUMENTS 3,887,190 A * 6/1975 Ameri ..... 273/264
4,515,370 A * 5/1985 Garcia ..... 273/258
4,674,750 A 6/1987 Abu-Shumays
4,723,382 A * 2/1988 Lalvani ..... 52/81.1
4,938,472 A * 7/1990 Gould et al. ..... 273/241
5,009,625 A 4/1991 Longuet-Higgins
5,100,359 A 3/1992 Gorio
5,524,396 A * 6/1996 Lalvani ..... 52/81.1
6,152,797 A 11/2000 David

* cited by examiner

*Primary Examiner*—Kien T. Nguyen

(57) ABSTRACT

This invention is a set of magnetic building blocks. Each block or piece in the set is in the shape of a right golden rhombic pyramid. There are two important fixed proportions that dictate each block's shape. The first is that the pyramid's base is a golden rhombus. That means the ratio of its long diagonal to its short diagonal is 1.618, otherwise known as $\phi$, or the "golden ratio."

The other important proportion of each block's shape is the height of the pyramid. The height of the pyramid as measured from the rhombus base centroid (the point at which the two base diagonals intersect) to its apex is $(\phi+1)/2$ or approximately 1.309 times the length of the short diagonal in the rhombus base.

Each building block has magnets embedded in its interior faces. This means that the pieces will stick together magnetically. The user can build various shapes and designs with the blocks. The set of building blocks can be used as a creativity tool, toy, puzzle, game, display device, creativity prop, and cognitive stimulant.

5 Claims, 8 Drawing Sheets

GOLDEN RHOMBIC PYRAMID-SHAPED BUILDING BLOCKS

CROSS-REFERENCED TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

This invention relates to recreational mental stimulation devices (such as toys, puzzles, and games), and specifically to creativity building blocks.

2. Prior Art

Playing with building blocks is a wonderful way to activate one's creative abilities. The forms that can be constructed with such building blocks are—to a great extent—a function of the shapes of the building blocks themselves. For example, building blocks in the shape of cubes can be assembled in a certain way; building blocks in the shape of rectangular solids or cylinders lend themselves to other forms of assembly. In addition, the individual shape of each building block has an impact not only on how the block "feels" in the user's hand, but also on the amount of manual satisfaction it creates when the user plays with it in conjunction with other similarly shaped blocks.

There exist a variety of different sets of building blocks, and these come in a variety of different shapes. Some examples include: cubes, rectangular solids, rhombohedrons, dodecahedrons, and hexagonal pyramids. There are, however, no sets of building blocks in which the individual pieces are in the shape of a right golden rhombic pyramid.

Many sets of building blocks use gravity for individual blocks to stick together with one another. Some sets of building blocks, though, use a variety of different means, in addition to gravity, to join and/or assemble the different pieces together. Some examples include: a set using tongue and groove connectors, another providing "mounting structures and interlocking mechanisms," and, a third using interior strip magnets coupled with exterior "spigots and recesses" to prevent "slippage" between the adjoining faces. All of these attachment systems are cumbersome.

OBJECTS AND ADVANTAGES

The current invention consists of a set of right golden rhombic pyramid-shaped magnetic building blocks. It has the following objects and advantages. The first advantage is the shape of each building block. As mentioned, it is in the shape of a right golden rhombic pyramid. The height of this pyramid is $(\phi+1)/2$ times the length of the rhombus-base's short diagonal. Note: $\phi$, otherwise known as the "golden ratio," is approximately equal to 1.618.

Not only does this shape make the individual pieces beautiful to look at and a joy to hold and manipulate in one's hand, this shape also endows the pieces with excellent "playability." In other words, because of their shape, the individual building blocks can be manipulated into a variety of distinct geometrical, and free-expression forms. These forms wouldn't necessarily result if each block were in a different shape such as a cube, dodecahedron, hexagonal pyramid, or a rhombohedron. To say this in another way, the playability of this set of building blocks, i.e., the many different ways in which the pieces can be put together, is a direct result of this right golden rhombic pyramid shape.

A second advantage of the present invention's design is the way in which the individual building blocks join together with one another. Because this invention uses strong disk magnets that are positioned in an interior magnet "well" at the center of each face of each piece, attraction between the individual pieces is strong. Indeed, the pieces practically "click" together when they are very close to one another. This creates a very satisfactory play experience. Also, this interior magnet design makes unnecessary the need for other assembly or attraction devices such as "tongue and groove connectors," or exterior "mounting structures and interlocking mechanisms" that are found on other sets of building blocks.

A third advantage of the present invention is that it comes with a book by creativity expert Roger von Oech entitled *Guidebook to the Ball of Whacks* (©2004 Roger von Oech, Creative Think, Menlo Park, Calif.). Among other things, this book provides the user with a proven method for using the pieces in a creative thinking workshop.

Further objects and advantages will become apparent from a consideration of the ensuing description and drawings.

SUMMARY

This invention is a set of magnetic building blocks. Each building block or piece in the set is in the shape of a right golden rhombic pyramid. There are two important features of each block's shape. The first is that the pyramid's base is in the shape of a golden rhombus. This means the ratio of rhombus's long diagonal to its short diagonal is 1.618, a number otherwise known as $\phi$, or the "golden ratio."

The other important feature of each block's shape is the height of the pyramid. The height of the pyramid as measured from the rhombus base centroid (the point at which the two base diagonals intersect) to its apex is $(\phi+1)/2$ or approximately 1.309 times the length of the short diagonal in the rhombus base.

These two fixed proportions—one dictating the shape of the pyramid's base, the other the pyramid's height—give each block its signature shape.

Each building block has magnets embedded in its interior faces. This means that the blocks will stick together magnetically. The user can build various shapes and designs with the blocks. One very beautiful shape that can be assembled with 30 pieces is the 30-sided polyhedron, the rhombic triacontahedron. A book by creativity expert Roger von Oech entitled *Guidebook to the Ball of Whacks* (©2004 Roger von Oech) accompanies the pieces, and provides the user with a proven method on how to use them in a creative thinking workshop.

The set of building blocks can be used as a creativity tool, toy, puzzle, game, display device, creativity prop, and cognitive stimulant.

DRAWINGS–FIGURES

A set of building blocks constructed in accordance with the invention is illustrated in the accompanying drawings; in which:

FIGS. 1-3 show the basic geometry underlying each of the golden rhombic pyramid-shaped pieces in this set of building blocks.

FIG. 1 shows the shape of a golden rhombus 32 that forms the base of this pyramid. The ratio of the rhombus's long diagonal 41 to its short diagonal 43 is equal to ϕ (phi), or approximately 1.618, a proportion otherwise known as the golden ratio. An acute angle 37 and an obtuse angle 38 are marked. The centroid 40, or the intersection point of the rhombus's two diagonals, is marked in the center of the rhombus. The long diagonal's length 42 is marked, as is the short diagonal's length 44.

FIG. 2 shows a side perspective 34 of the golden rhombic pyramid shape, from the short diagonal view. This view highlights the pyramid's height 46 from the centroid point 40 in its rhombus base to the apex 48 . This height is (ϕ+1)/2 or approximately 1.309 times the length of the short diagonal 44 in the rhombus base 32.

FIG. 3 shows a side perspective 36 of the golden rhombic pyramid shape, from the long diagonal view. This view also highlights the pyramid's height 46 from the centroid point 40 in its rhombus base to the apex 48 of each piece. This height is (ϕ+1)/2 or approximately 1.309 times the length of the short diagonal 44 in the rhombus base 32.

FIG. 4 is a perspective view of a single building block 18, and shows its two main components, the cap 20 and the cone 22.

FIG. 5 shows a top-down view of each building block's rhombus base in the cap section 20 of each piece 18.

FIG. 6 shows a side view of the golden rhombic pyramid-shaped building block 18 from the short diagonal perspective. The block's cap 20 and cone 22 sections are marked.

FIG. 7 is similar to FIG. 6 but from the long diagonal perspective.

FIGS. 8-9 are plans for the plastic moldings for the two sections 20 and 22 that comprise each piece 18.

FIG. 8 shows the cap section 20. Note the positions of the magnet wells 26 where the magnet disks are placed, and the ribs 24 that keep the magnet disks from the opposing section in place. Also shown is the step joint 28 where the two sections are joined together.

FIG. 9 shows the cone section 22. Note the positions of the magnet wells 26 where the magnet disks are placed, and the surrounding magnet houses 30.

FIG. 10 shows how 30 building blocks can be assembled to make a 30-sided polyhedron, the Rhombic Triacontahedron.

FIG. 11 shows a star made from five building blocks.

FIG. 12 shows a "top" made from three building blocks.

LIST OF REFERENCE NUMERALS

Figure 1:
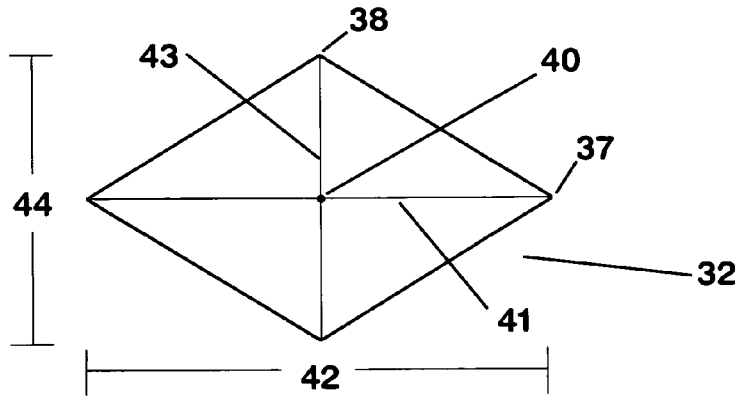

18 One individual building block or piece in the set
20 Cap section
22 Cone section
24 Interior rib
26 Magnet well
28 Step joint
30 Magnet house
32 A golden rhombus
34 Side perspective, from the short diagonal view, of a golden rhombic pyramid shape
36 Side perspective, from the long diagonal view, of a golden rhombic pyramid shape
37 Approximately 63.43.degrees, or size of the acute angles in a golden rhombus
38 Approximately 116.57.degrees, or size of the obtuse angles in a golden rhombus
40 Centroid, or the point where the two diagonals in the rhombus intersect
41 Long diagonal of the rhombus
42 ϕ (phi), or approximately 1.618, which is the length of a golden rhombus's long diagonal in ratio to its short diagonal if the short diagonal is =1.000
43 Short diagonal of the rhombus
44 1.000, or length of a golden rhombus's short diagonal if the length of the long diagonal is ϕ (phi), or approximately 1.618
46 (ϕ+1)/2, or approximately 1.309, which is the height of the pyramid shape in this invention if the short diagonal in the golden rhombus base=1.000 and the long iagonal =ϕ or approximately 1.618
48 Apex of the pyramid

DETAILED DESCRIPTION—PREFERRED EMBODIMENT

The present invention relates to a set of golden rhombic pyramid-shaped building blocks, which are constructed in such a way that any piece is capable of being held together face to face magnetically with any other piece in the set.

There are two important features of this pyramid shape. The first is the golden rhombus base 32. Please see FIG. 1. A rhombus is a four-sided equilateral with two pairs of parallel sides. For a rhombus to be golden, the ratio of its long diagonal 41 to its short diagonal 43 must be approximately 1.618. This number is also known as ϕ (phi) or the "golden ratio." The acute angles in a golden rhombus are approximately 63.43.degrees 37, and the obtuse angles are approximately 116.57.degrees 38.

Figure 2:
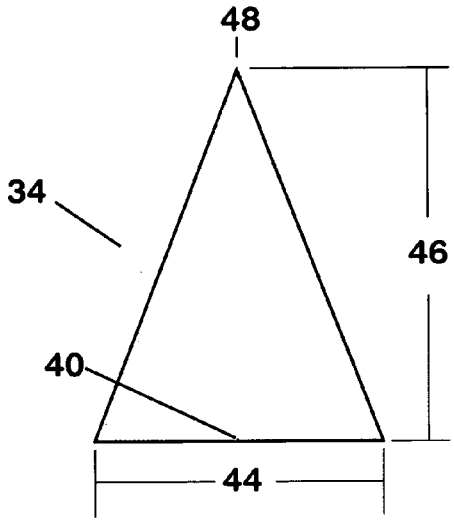
Figure 3:
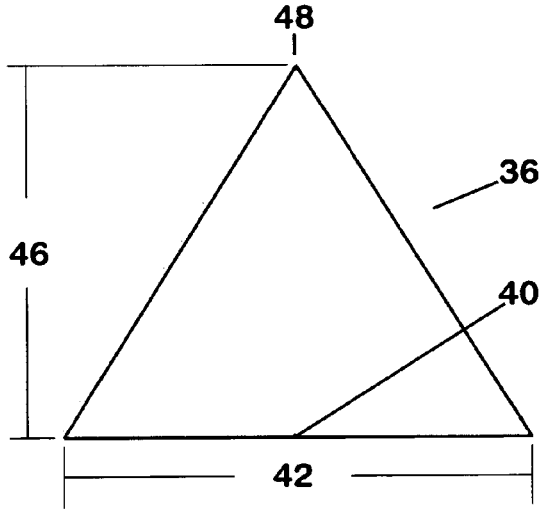
Figure 4:
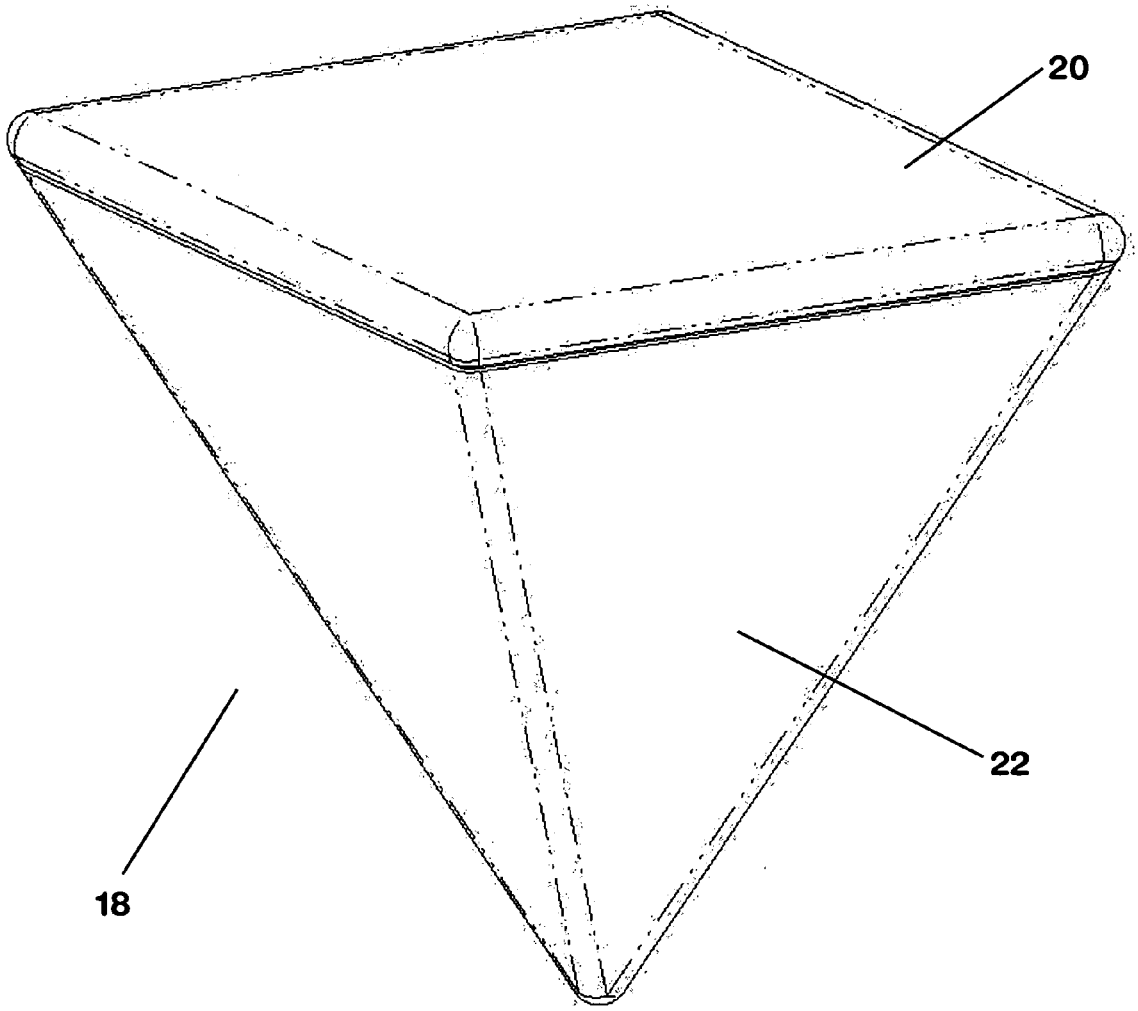
Figure 5:
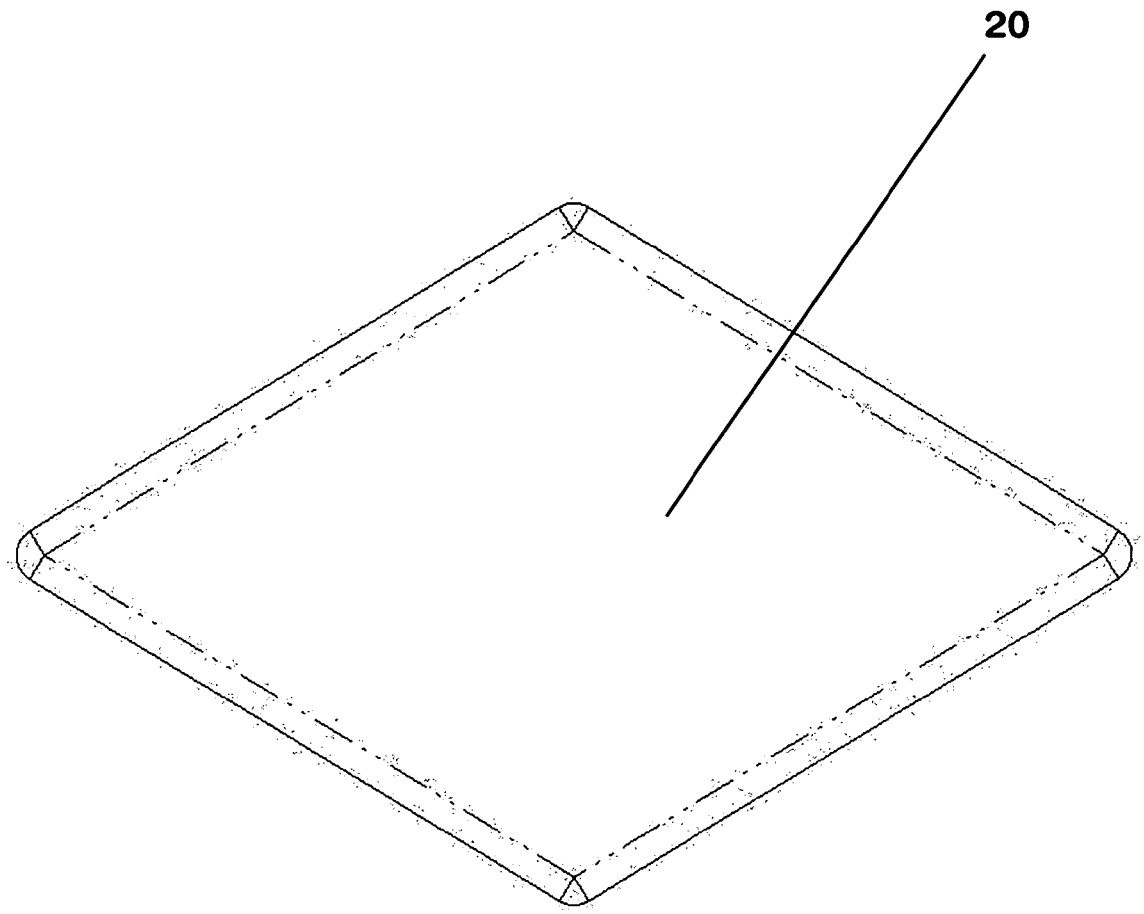
Figure 6:
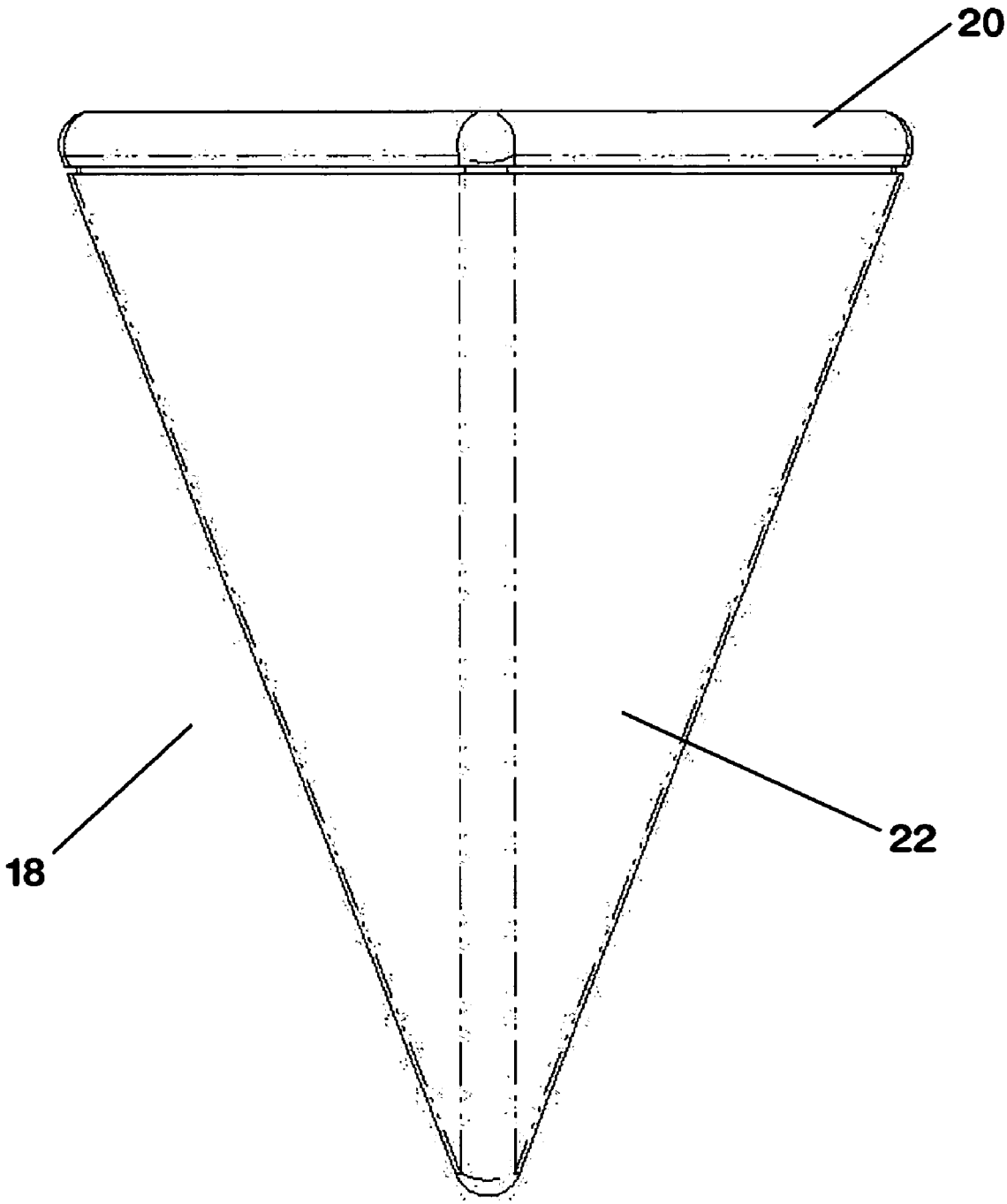
Figure 7:
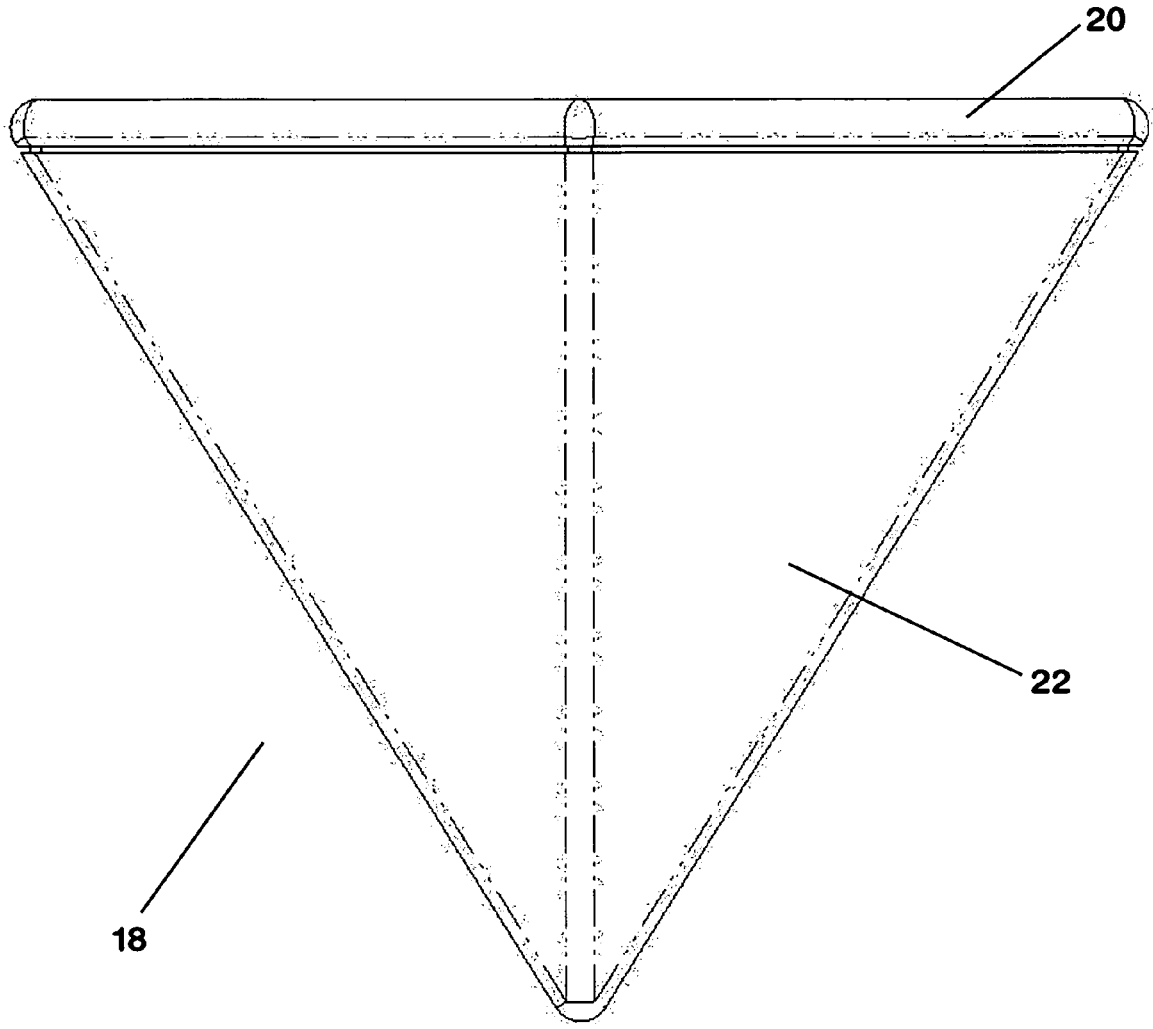

The other important feature of each block's golden rhombic pyramid shape is its height. In each piece, the height of the pyramid as measured from the rhombus base centroid 40, or point at which the two rhombus base diagonals intersect, to its apex 48 is (ϕ+1)/2 or approximately 1.309 times the length of the short diagonal 44 in the rhombus base. See FIGS. 2-3. It is this proportion that gives each piece its signature shape.

The individual building blocks or pieces are molded from plastic material. Other construction materials are also possible: in addition to plastic, I have made the pieces out of metal (aluminum), wood, MGF (medium grade fiberboard), cardboard, and paper.

Figure 8:
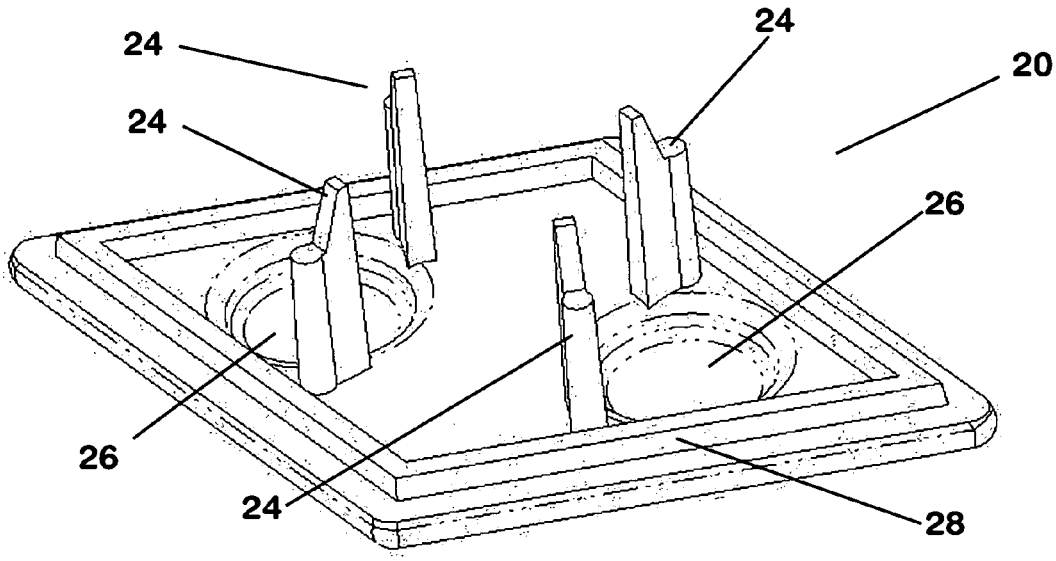
Figure 9:
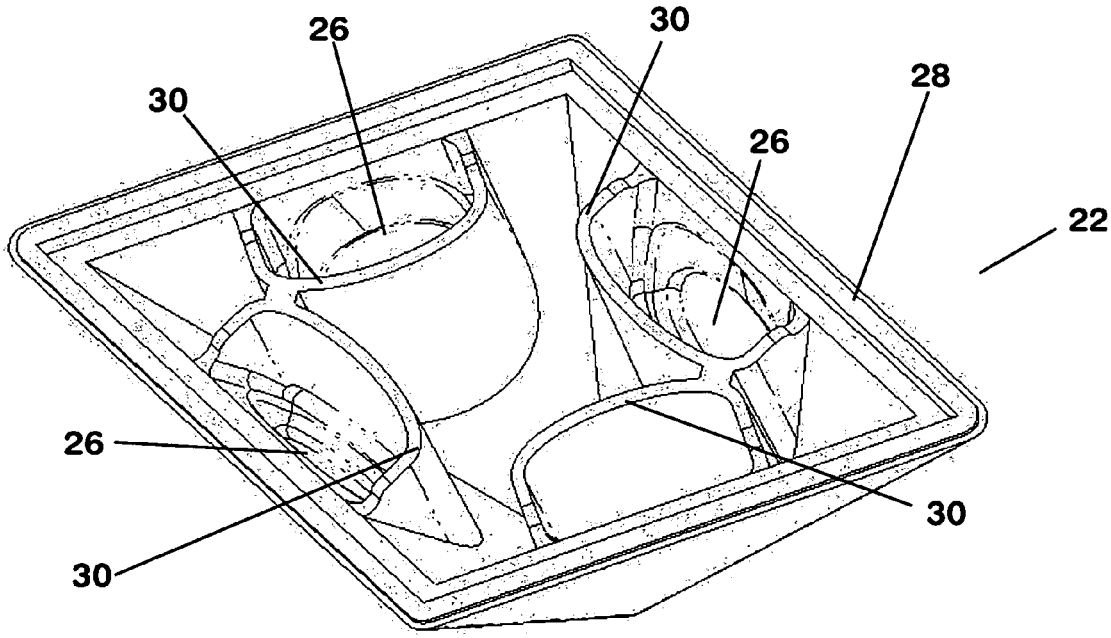

Each building block 18 is comprised of two sections: a rhombus-shaped cap section 20, and a pyramid-shaped cone section 22. See FIG. 8 for the cap, and FIG. 9 for the cone. The magnetic attraction of each piece is provided by disk magnets, which are placed in a magnet well 26 in the interior of each of the five faces of each building block.

The cone section 22 has four magnet wells 26. See FIG. 9. The position of these magnets is as such: from the long diagonal side perspective, the left triangular face will always have a magnet of north polarity facing out, and the right triangular face will always have a magnet of south polarity facing out. That means that the left and right and right triangular faces of different pieces will attract and stick together.

The cap section 20 has two magnet wells 26. See FIG. 8. One magnet with north polarity facing out will be placed in one of the magnet wells; another magnet with south polarity facing out is placed in the other magnet well. Having two polarity-differing magnets in each cap section 20 allows for any two pieces to be joined together at the base. If there were only one magnet well, then half the pieces would be north, and the other half would be south. This would mean that each piece could only be joined at the base with only half of the pieces, not all of the pieces as per the design on the invention.

The building blocks 18 are for the most part hollow except for interior ribs 24 that hold the disk magnets in place in the interior faces. One benefit of using these ribs is that there is no need for an adhesive to keep the magnets in place.

After the magnets are placed in their assigned positions within the cap and the cone sections, the cap 20 and the cone 22 are assembled and ultrasonically welded together.

Figure 10:
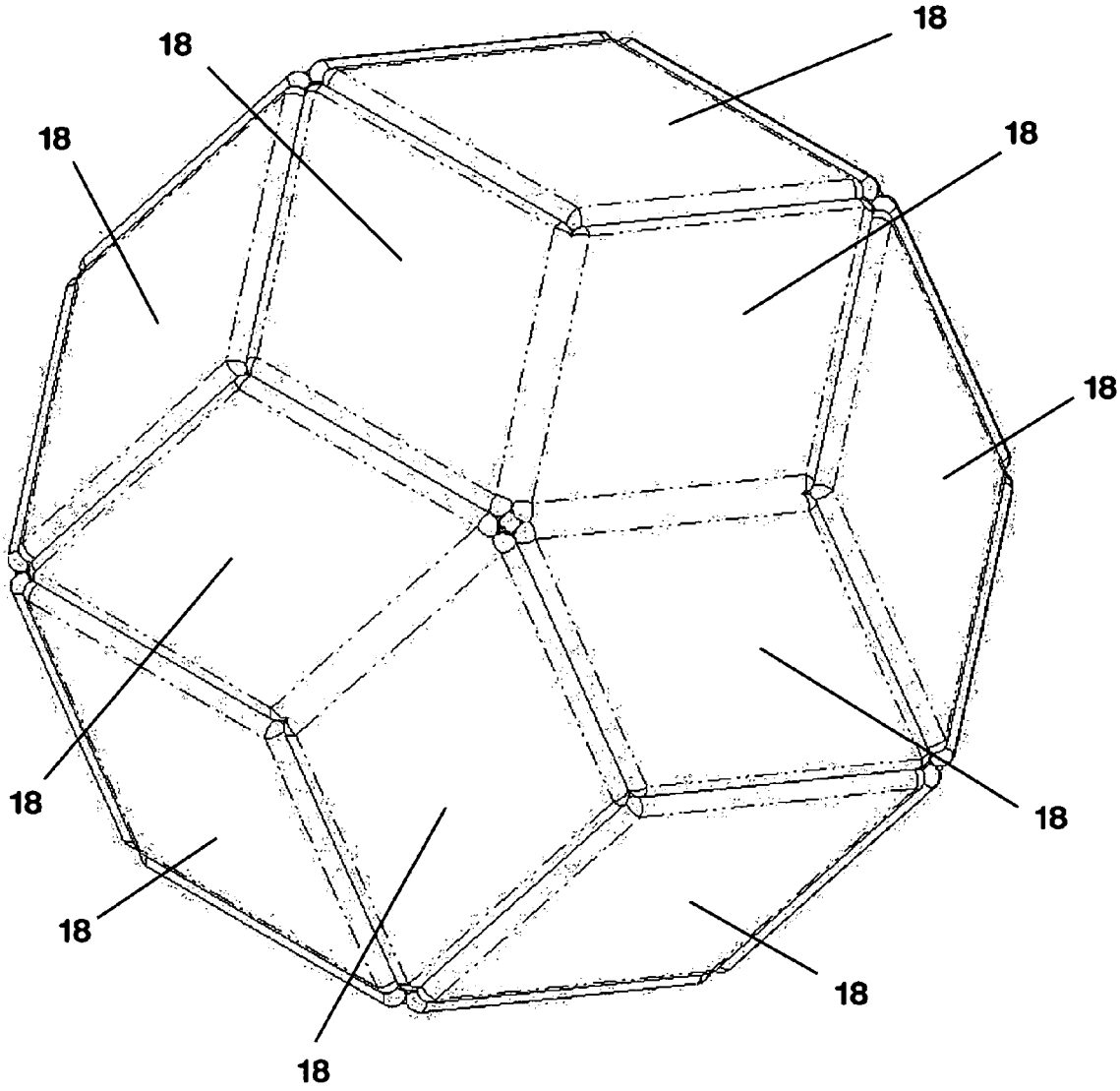
FIGS. 10-12 show some examples of some of the shapes that can be made with the building blocks 18.

The user of these building blocks can create many different and various shapes with them. Particularly significant is that 30 of these pieces can be put together to form a rhombic triacontahedron, a polyhedron consisting of 30 golden rhombi. See FIG. 10.

Figure 11:
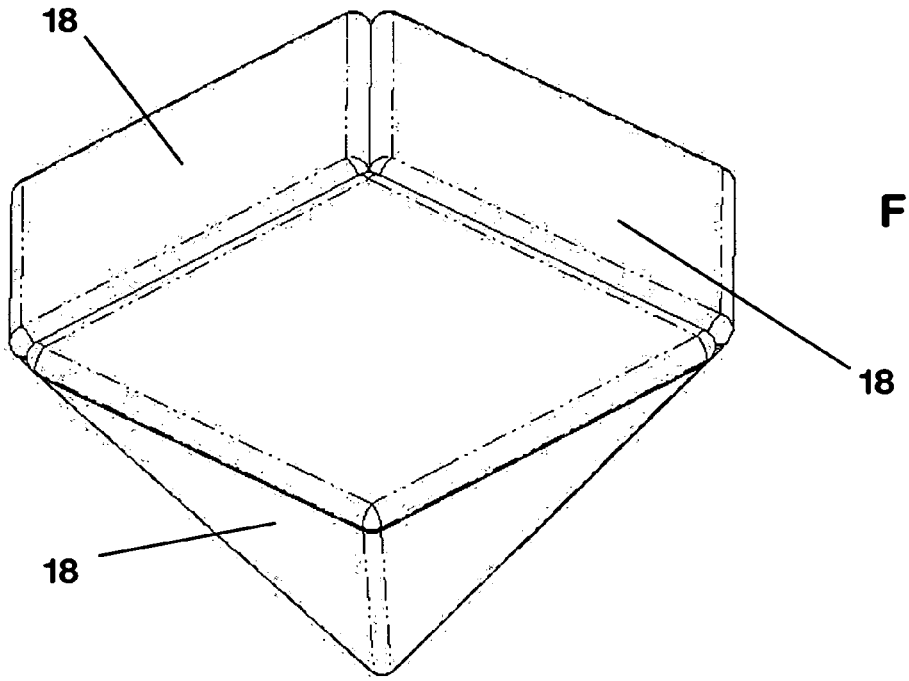
Figure 12:
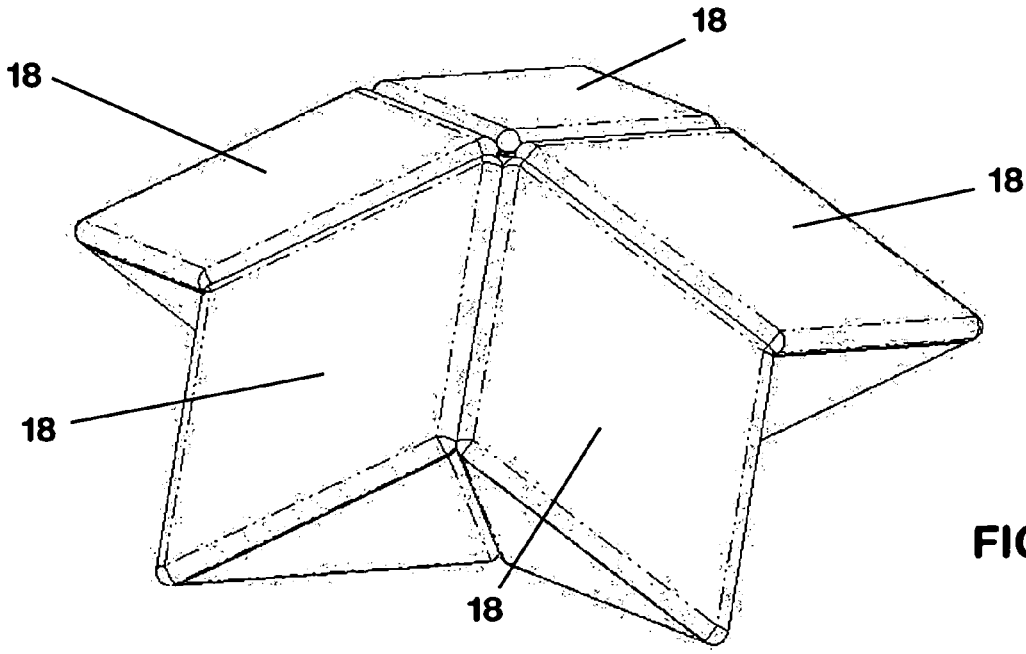

This invention is a set of building blocks or pieces that can be used as a creativity tool, a creative thinking toy, a puzzle, a relaxant, a display device, and a prop in a creativity workshop. Many geometric shapes can be created with them. The set can also be used to create irregular forms by way of free expression. For a few examples, see FIGS. 10-12. Also, the very act of manipulating the pieces is cognitively stimulating. In addition, each piece has abundant space available on its five faces to apply messages—such as words, pictures, or symbols. Such an application can lead to additional uses such as marketing, communication, gaming, and divination.

CONCLUSION, RAMIFICATIONS, AND SCOPE

Accordingly the reader will see that, according to the invention I have provided a set of building blocks that can be used as a creativity tool, a creative thinking toy, a puzzle, a relaxant, a display device, and a prop in a creativity workshop.

While the above description contains many specifics, these should not be construed as limitations on the scope of the invention, but as exemplifications of the presently preferred embodiments thereof. Many other ramifications and variations are possible within the teachings of the invention.

Thus, the scope of the invention should be determined by the apparent claims and their legal equivalents, and not by the examples given.

I claim:

1. A set of creativity building blocks, in which a) each of said building blocks is in the shape of a pyramid;

b) each of said building blocks has a pyramid base in the shape of a golden rhombus, that is, a rhombus that possesses two pairs of angles that are 63.43° and 116.57° respectively, and has the ratio of its long diagonal to its short diagonal being 1.618, a number otherwise known as $\phi$ or the golden ratio;

c) each of said building blocks is in the shape of a right pyramid, meaning that the apex of the pyramid is perpendicular to the base's centroid, or point where the two rhombus base diagonals intersect; and d) each of said building blocks has a specific height proportion that gives it its signature shape, namely the height of the pyramid as measured from the centroid of its rhombus base to its apex is $(\phi+1)/2$ or 1.309 times the length of the short diagonal in the rhombus base.

2. A set of creativity building blocks according to claim 1 that is constructed so that each building block or piece is capable of being held together with any of the other pieces face to face magnetically.

3. A set of creativity building blocks according to claim 2, in which a) each of said building blocks consists of two parts, a rhombus-shaped cap section, and a pyramid-shaped cone section, and which are joined together to create each individual block or piece in the set;

b) each of said building blocks is hollow with interior ribs that hold magnetic disks in place in each interior face in a magnet well or recessed area;

c) each of said building blocks has a single magnetic disk positioned in a magnet well on the interior side at the center of each of the four triangular faces in the cone section; and, d) each of said building blocks has two magnetic disks positioned on the interior side of the cap section, and one each of these two magnetic disks is placed in a magnet well in the center of each of the two isosceles triangles created by dividing the rhombus base in half through its short diagonal.

4. A set of creativity building blocks according to claim 3, in which 30 of said building blocks can be assembled compactly together to form the 30-rhombus-sided polyhedron, the rhombic triacontahedron.

5. A set of creativity building blocks according to claim 3, that can be constructed from a variety of materials including plastic, metal, wood, cardboard, fiberboard, and paper.

* * * * *